US006170312B1

(12) United States Patent
Bravo et al.

(10) Patent No.: US 6,170,312 B1
(45) Date of Patent: Jan. 9, 2001

(54) HYDRAULIC LOAD CAPSULE FOR A METAL WORKING ROLLING MILL

(75) Inventors: Jean-Pierre Bravo, Les Lilas; Robert Benod, Bard, both of (FR)

(73) Assignee: Vai Clecim, Courbevoie (FR)

( * ) Notice: Under 35 U.S.C. 154(b), the term of this patent shall be extended for 0 days.

(21) Appl. No.: 09/550,902

(22) Filed: Apr. 17, 2000

(30) Foreign Application Priority Data

Apr. 16, 1999 (FR) ..... 99 04840

(51) Int. Cl.[7] ..... B21B 31/07; B21B 31/32
(52) U.S. Cl. ..... 72/245
(58) Field of Search ..... 72/240, 245, 248, 72/237

(56) References Cited

U.S. PATENT DOCUMENTS 3,596,490 * 8/1971 Willeke et al. ..... 72/245
3,852,984 * 12/1974 Greenberger ..... 72/245
5,355,707 * 10/1994 Inoue et al. ..... 72/245

FOREIGN PATENT DOCUMENTS 2 570 003 9/1984 (FR) .
2570003 * 3/1986 (FR) ..... 72/245
2 645 051 3/1989 (FR) .
WO94/00254 1/1994 (WO) .

OTHER PUBLICATIONS

Stanley et al, Hydraulic conversion and modernization of hot strip mill at Gulf States Steel, Mar. 1999 Iron and Steel Engineer, pp. 48–52.
Abstract of SU1128995, 1984.

* cited by examiner

*Primary Examiner*—Rodney A. Butler
(74) *Attorney, Agent, or Firm*—Arent Fox Kintner Plotkin & Kahn, PLLC

(57) ABSTRACT

This invention relates to a roll mill comprising hydraulic clamping devices acting on at least one roll (2) with adjustable level, and devices for measuring the position of the adjustable roll, comprising, at each end (42) of the roll, a measuring rod (4) going through a tubular sleeve (5) with a certain clearance for insulating the pressure chamber (33). According to the invention, the clamping jacks (3) are single-action and the insulating sleeve (5) connected to each jack is extended by a sheath (53) going through the roll standard of the stand up to an external end on which rest devices for restoring the jack (3), in the direction opposite the clamping direction, while resting on the standard of the stand.

8 Claims, 2 Drawing Sheets

HYDRAULIC LOAD CAPSULE FOR A METAL WORKING ROLLING MILL

FIELD OF THE INVENTION

This invention relates to improvements made to roll mills provided with a hydraulic clamping system comprising, in particular, means for registration of the relative positions of the rolls.

BACKGROUND OF THE INVENTION

It is known that, generally, a roll mill comprises, inside a fixed stand, at least two working rolls delineating an air-gap for the product to run along a rolling plane. In order to maintain the space between the working rolls, which determines the reduction in thickness of the product, the said working rolls rest, generally, via rolls with larger diameter, so-called back-up or bearing rolls, on clamping means resting themselves on the stand.

A 'quarto'-type roll mill, for instance, comprises two working rolls resting respectively on two back-up rolls. In a 'sexto'-type roll mill, an intermediate roll is interposed between each working roll and the corresponding back-up roll. But other types of roll mills are also known.

The roll stand comprises normally two vertical roll standards connected by a crosspiece and on which are mounted clamping means resting, respectively, on each end of a roll with adjustable level, generally a back-up roll. Each roll is carried by a rotation shaft rotating, at both its ends, inside bearings each installed in a supporting block, called a 'chock' and capable of sliding, along a clamping plane running through the axes of the working rolls, inside a window provided inside the corresponding roll standard of the stand.

All these arrangements are well known and do not call for any detailed description.

Until now, the rolls were clamped by screw-nut type mechanical devices, for instance, a screw resting, via an internal end, on the corresponding chock of the back-up roll and engaging into a fixed nut resting, in the opposite direction, on the roll standard, whereas the screw was driven into rotation in one direction or the other in order to grip or to release the rolls.

However, for several years, hydraulic clamping devices that comprise, on each roll standard, two elements sliding into one another, respectively a mobile element resting on the chock of the roll and a fixed element resting on the roll standard, have been used preferably.

Using hydraulic jacks enables, in particular, to facilitate the control of the rolling load and to regulate the thickness of the product rolled. To this end, it is necessary to provide rapid response of the system and, consequently, to know with accuracy the position of the roll that is adjustable in relation to the stand, from which the positions of the other rolls can be determined.

To this end, the applicant has already suggested, in the French patent no. 2.645.051, a roll position registration device comprising, in each roll standard, a measuring rod extending along the axis of the clamping jack between an internal end turned to the window and fixed on the mobile element of the jack and passing through the roll standard up to an external end connected to a position transducer. This rod must therefore go through the pressure chamber of the jack and, in this view, it has to pass through an insulating sleeve with one internal end fixed on the mobile element of the jack and an insulating section mounted to slide in relation to the fixed element, whereas a sliding seal is interposed in order to maintain the pressure inside the chamber of the jack without disturbing the displacements of the mobile element of the said jack.

The measuring rod goes through the tubular sleeve with a certain clearance in order to avoid any disturbance of the measurement, whereby the rod has no contact with any section of the roll mill, apart from the mobile element of the jack on which it is fixed.

Thanks to such an arrangement, it is possible to know at any time, with accuracy, the position with respect to the stand of the mobile element, of the jack and of the roll on which the clamping load is applied, in order to make the necessary corrections, for example, to take into account any yields and other deformations due to the application of the clamping load or to correct any thickness or surface evenness defects detected downstream.

Moreover, it must also be possible to move the jacks over a wide amplitude to suit various thicknesses of the product as well as variations in diameter of the rolls that are subject to quite a severe wear. These rolls must, besides, be replaced periodically and, in this view, they should be brought into a dismantling position for which they are spread apart from one another.

Manoeuvring the rolls can be made via auxiliary jacks, but it is also possible to use two-direction double-action clamping jacks. Normally, the body of the jack is fixed and rests on the roll standard, whereas the mobile piston 5 rests on the rolled to be adjusted and delineates two chambers, respectively a main chamber dedicated to the application of the clamping load and a ring chamber for restoring the jack into the opposite direction. However, this arrangement complicates the oil supply system of the jack, which is not symmetrical. Moreover, tightness in both chambers of the jack is not easy to provide, taking into account the necessary high pressures, and generates frictions that are detrimental to thickness regulation.

It is therefore easier to use single-action jacks that comprise a single chamber, whereas the application of the pressure determines the displacement of the piston only in the clamping direction. But it is necessary to provide means for restoring the piston into the opposite direction.

During the rolling operation, the restoring force is provided by the product itself. When the machine has stopped, conversely, only the auxiliary jacks are available, which are used normally for balancing the weight of the rolls and, if needed, for exerting bending to compensate for the deflection of the rolls. However, these balancing jacks act on the chocks of the rolls and can therefore not be used for maintaining the clamping jacks in raised position, during roll changing phases before proceeding to maintenance operations.

Therefore, when single-action jacks are used, they may be associated with locking devices fitted with clamping claws, actuated by auxiliary jacks, that maintain at least the jacks under their own weights during dismantling operations. Such devices, still, have not been designed to operate within the framework of a normal sequence and can be destroyed in case of mistakes since they, obviously, have not been designed to sustain the thrust of the clamping jacks. Such accidents cause stoppages for repairs that are extremely detrimental to production.

The invention allows to obviate such drawbacks while suggesting a particularly simple restoring device, applicable to single-action clamping jacks and that advantageously uses the existing arrangements, without complicating the roll stand any further.

Moreover, the invention is especially useful for retrofitting the existing stands.

SUMMARY OF THE INVENTION

The invention therefore relates, generally speaking, to a roll mill of the type described previously, in which the means for clamping the rolls comprise two hydraulic jacks mounted respectively on both roll standards of the stand and each comprising two elements mounted to slide one into the other and delineating a pressure chamber that is supplied with pressurised fluid, respectively, a mobile element resting on the supporting block of the corresponding end of the adjustable roll and a fixed element resting on the roll standard of the stand, whereas the said mill is provided with means for measuring the position of the adjustable roll comprising, at each end of the roll, a measuring rod with an internal end connected to the mobile element of the clamping jack and extending successively through the pressure chamber, the fixed element of the jack and roll standard of the stand, up to an external end located outside the stand, whereas the said rod goes through a tubular sleeve with a certain clearance that extends into the pressure chamber of the jack in order to preserve the tightness thereof, whereas the said sleeve has an internal end axially integral with the mobile element of the jack and exhibits an insulating section mounted to slide with respect to the fixed element.

According to the invention, the insulating tubular sleeve connected to each jack is extended to the outside, beyond the sliding insulating section, by an oblong linking member extending along the measuring rod and going through the roll standard of the stand up to an end located outside the stand on which is fixed a back-up section of restoring means of the mobile element of the jack toward the fixed element, whereas the said restoring means rest on the roll standard of the stand and act onto the mobile element via the linking member and the insulating sleeve, in the direction opposite the clamping direction.

In a particularly advantageous embodiment, the linking member is fixed, at its end located outside the roll standard, on at least one arm extending transversally and the restoring means comprises at least one jack having a fixed element resting on the roll standard in a transversally offset position with respect to the measuring rod and a mobile element resting on the said transversal arm.

Preferably, the linking member is connected to at least two transversal arms extending symmetrically and forming a joystick on which rest at least two restoring jacks offset on either side of the measuring rod.

Advantageously, a joint is arranged between the sleeve and the linking member in order to allow for misalignments.

In a preferred embodiment, the oblong linking member is a tubular sheath extending along the insulating sleeve and comprising a central bore with sufficient diameter for the measuring rod to pass through it with a certain clearance.

According to a first embodiment, the clamping jack comprises a hollow fixed body resting on the roll standard of the stand and a mobile piston resting on the supporting block of the roll.

According to another embodiment, the clamping jack comprises a fixed piston resting on the roll standard of the stand and a mobile hollow body resting on the supporting block of the roll.

BRIEF DESCRIPTION OF THE DRAWINGS

But the invention will be understood better by the following description of certain embodiments, given for exemplification purposes, and represented on the appended drawings.

DETAILED DESCRIPTION OF THE PREFERRED EMBODIMENT

As indicated above, the invention may apply to any type of roll mill comprising several rolls, superimposed inside a stand comprising two separate roll standards, fixed on a foundation block and connected by a crosspiece.

Figure 1:
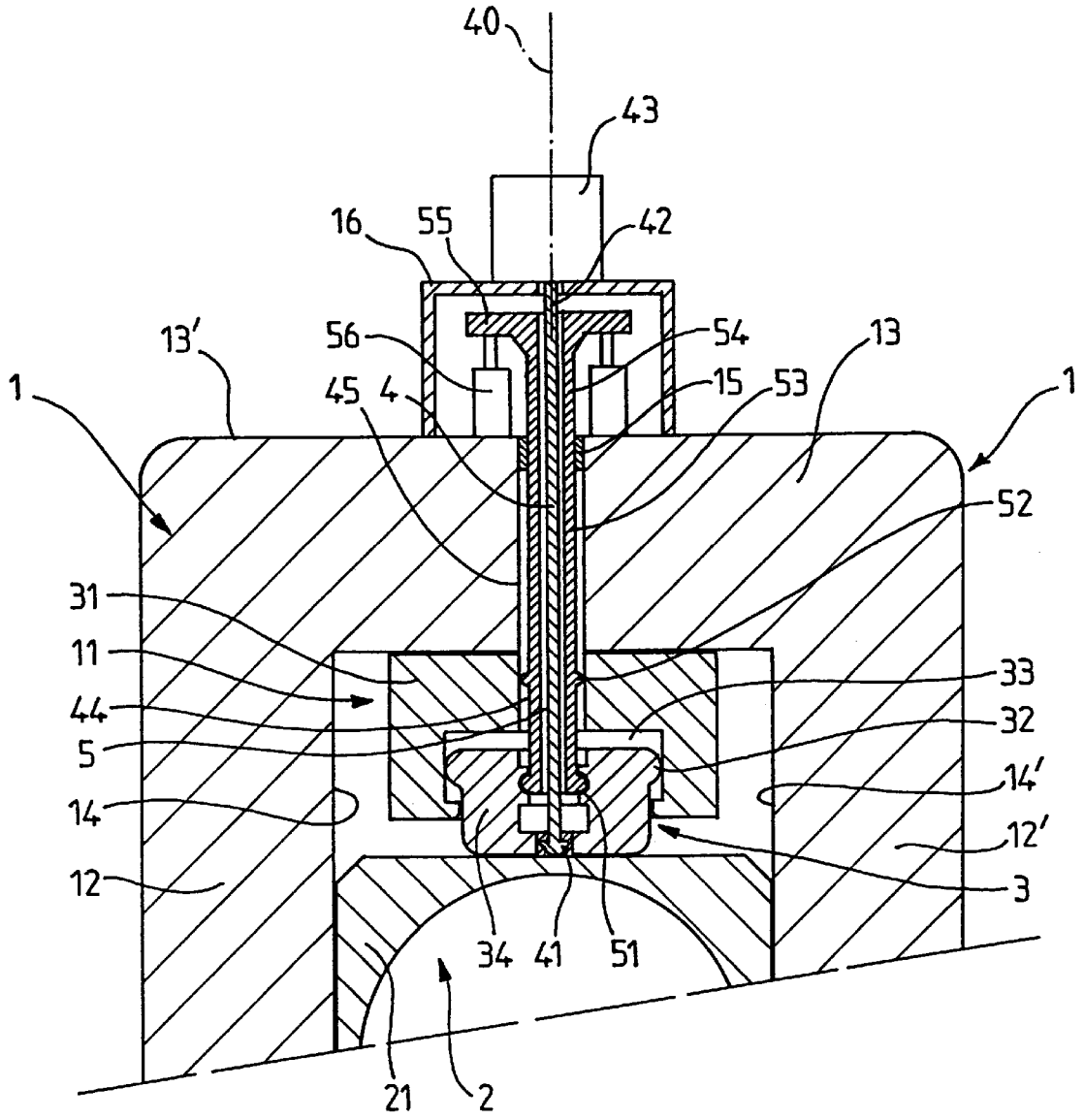
FIG. 1 shows diagrammatically a first embodiment of the invention.

FIG. 1 that applies to a quarto or sexto roll mill with one back-up roll 2 whose level is adjustable, only represents the upper section of a roll standard 1 in which is provided a window 11 designed for guiding a chock 21 of the roll 2. The roll standard exhibits, usually, the shape of a closed frame comprising two uprights 12, 12' and an upper crosspiece 13. Both sides of the window 11 form guiding faces 14, 14' of the chocks of the rolls.

Between the chock 21 and the crosspiece 13 of the roll standard 1 is interposed a hydraulic clamping jack 3 comprising a cylindrical body 31 in which a piston 32 is mounted sliding, delineating a pressure chamber 33 that can be supplied with pressurised fluid by a not represented hydraulic system.

In the embodiment represented on FIG. 1, the body 31 makes up the fixed element of the jack that rests on the crosspiece 13 of the roll standard 1, whereas the piston 32 constitutes the mobile element that rests on the chock 21 via a front section 34 forming the rod of the jack. The roll mill is provided with a device for measuring the position of the roll 2, of the type described in the French patent no. 2.645.051 and comprises, consequently, a measuring rod 4 with an internal end 41 axially integral with the mobile element 32 of the jack and that goes through the fixed element 31 and the roll standard 1 up to an external end 42 connected to a measuring device 43 located outside the roll standard 1. The rod 4 goes therefore, in succession, through a bore 44 provided in the bottom of the body 31 of the jack and through a bore 45 provided in the crosspiece 13 of the roll standard 1.

To insulate the pressure chamber 33, a tubular sleeve 5 is interposed between the mobile element 32 and the fixed element 31 of the jack 3. This sleeve 5 hangs, via its internal end 51, from the piston 32 and is mounted sliding, at its opposite end 52, along the bore 44 of the body 31 of the jack, whereas an insulating sliding joint is interposed. Thus, the sleeve 5 can follow the displacements of the piston 32, whereas the sliding section 52 insulates the pressure chamber 33.

The sleeve 5 is provided with a central bore with diameter greater than that of the rod 4 that goes through this bore with a certain clearance, without contacting the sleeve. Thus, the measurement should not be disturbed by misalignments caused, for instance, by deformations of the various sections of the stand.

Particularly, the roll 2 can be subject to bending as the product passes and it is necessary to leave clearances between the guiding faces 14, 14' of the roll standard and the chock 21 that can be slightly offset with respect to the stand.

In the arrangement of FIG. 1, the piston 32 rests directly on the chock 21 and can therefore itself be subject to misalignments with respect to the fixed body 31 resting on the roll standard 1. These misalignments can be compensated for by the sleeve 5 that, in the arrangement according to the French patent no. 2.645.051 already mentioned, is connected respectively to the piston 32 and to the fixed body 31 of the jack via swivel joints 51, 52. Obviously, the clearance between the measuring rod 4 and the tubular sleeve 5 must be sufficient to allow for these misalignments without any risks of contact between both parts.

All these arrangements are described in detail in the patent already mentioned but other assemblies are possible as well.

For example, as indicated diagrammatically on FIG. 1, a swivel joint can be provided between the piston 32 and the body of the jack 31 in order to allow for misalignments of one element with respect to the other, but it is more difficult to ensure tightness of the ring chamber located between the rod 34 of the jack and the cylindrical body 31.

When a double-action jack is used, it is therefore preferable to keep the alignment of both elements of the jack, but then a swivelling rest must be provided between the mobile element of the jack and the chock, which would compensate for any possible misalignments. Such an arrangement determines, however, concentration of the stress at the resting point.

It is therefore preferable, as shown on FIG. 1, to use a single-action jack whose mobile element 32, 34 rests directly on the chock 21 via a flat face enabling distribution of the loads, but whose piston may pivot slightly with respect to the body of the jack, whereby the tubular sleeve enables, as already seen, compensating for misalignments. However, if a single-action jack is used, it is necessary to provide means for restoring the jack into the direction opposite the clamping load.

This invention solves this problem in a particularly simple way while using, for restoring purposes, the tubular sleeve 5 that is necessary, in any case, to ensure tightness of the pressure chamber 33.

To this end, the sleeve 5 is followed, on the side opposite the roll 2, by an oblong linking member 53 extending along the measuring rod 4, without contacting the said rod, and passes through the bore 45 to end outside the stand, on the other side of the crosspiece 13 of the roll standard 1. At its external end 54, the linking member 53 is provided with two transversal arms 55 extending symmetrically on either side of the axis 40 of the measuring rod 4, in order to form a joystick on which rest two jacks 56 mounted on the external face 13' of the crosspiece 13.

On the preferred embodiment represented on the figures, the linking member is a tubular sleeve 53 delineating a central bore in which passes the measuring rod 4 with a certain clearance and that extends in the alignment of the insulating sleeve 5 in order to protrude outside the stand 1.

As already indicated, the sleeve 5 is axially integral with the piston 32 of the jack, by its lower end 51 that forms a swivelling joint.

Consequently, the jacks 56 resting on the crosspiece 13 and, on the opposite side, on the joystick 55, enable, via the sleeve 53, retraction of the piston 32 in the reverse direction of the clamping load, whereas the pressure chamber 33 is obviously blanked for that purpose.

The arrangement known previously can thus fulfil a new function thanks to the addition of the extension sheath 53 and the jacks 56 acting as means for restoring the single-action jack 3. Obviously, the bore 45 must simply exhibit sizes that are sufficient to enable the sheath 53 to go through with a certain clearance.

Similarly, the measuring rod 4 goes inside the sheath 53 with a certain clearance, which constitutes a simple extension of the insulating tubular sleeve 5.

If the pressure chamber 33 is kept tight by the sliding joint 52 of the tubular sleeve 5, the sheath 53 can go freely inside the bore 45. However, it is preferable to place, at the outlet of the bore 45, a sliding joint 15 allowing to guide the sheath 53 that is then held laterally by both sliding joints 52 and 15.

If the sliding joint 15 is capable of keeping the chamber of the jack 33 tight to the pressure of the fluid, it may be contemplated to eliminate the swivelling joint 52, the ratio between the length and the transversal sizes of the sheath 53 giving to said sheath sufficient flexibility to accommodate any misalignments of its opposite end 51 with the piston 32.

Besides, the extension sheath 53 does not necessarily form a single piece with the sleeve 5, but it can be connected to the said sleeve by a hinge that may accommodate misalignments.

The assembly consisting of the joystick 55 and of the restoring jacks 56 can be located in the lid 16 on which is fixed the measuring device 43 connected to the end 42 of the measuring rod 4.

In the example on FIG. 1, the body 31 of the jack is fixed and is therefore arranged in the upper section of the window 11. However, the angles of the window 11 are, normally, rounded to ensure continuous transmission of the clamping loads on the uprights 12, 12' of the roll standard and it may prove difficult to lay therein the body of a jack with sufficient section. It may be therefore interesting to reverse the arrangement on FIG. 1, whereas the piston 32 of the jack is fixed whereas the cylindrical body 31 is mobile and rests on the chock 21 of the roll 2, whereby the body 31 of the jack can exhibit an upper side matching the profile of the lower face of the crosspiece 13 while providing for an internal chamber 33 with sufficient section for exerting the necessary clamping load without increasing the pressure unduly.

Such an arrangement is particularly interesting for retrofitting an existing stand.

Indeed, the former stands are usually provided with screw-nut type mechanical clamping devices comprising, on each roll standard, a screw driven into rotation, in either direction, by external means, and whose internal end rests on the chock of the roll to be displaced, whereby the screw turns inside a rotation-fixed nut and that rests, in the opposite direction, on the roll standard.

The invention enables, without replacing the roll standards of the stand, to suit a hydraulic clamping device to a roll mill of such type.

Figure 2:
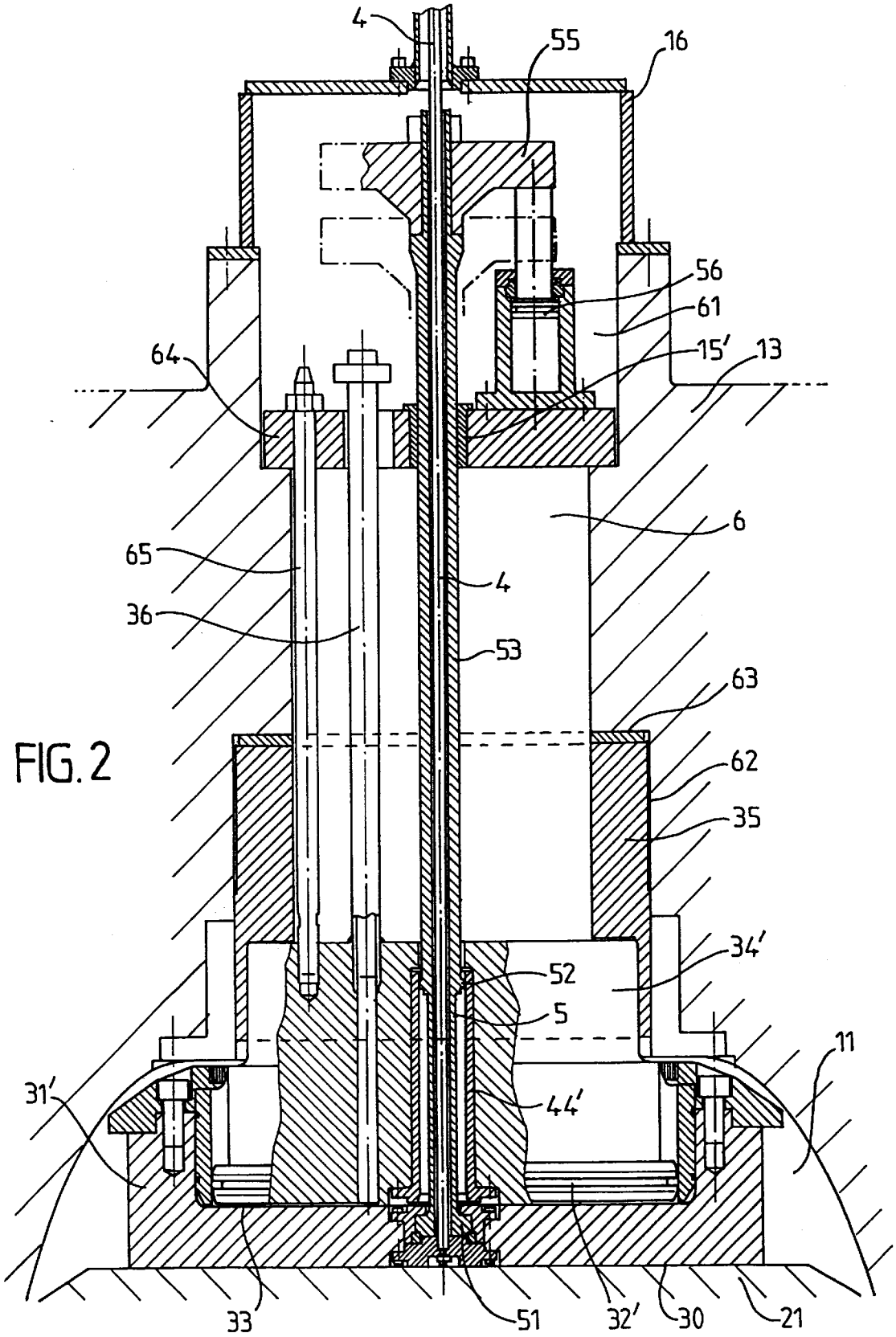
FIG. 2 shows a second embodiment of the invention suited, in particular, to the retrofitting of an existing roll stand.

FIG. 2 represents only the central section of the crosspiece 13 of a roll standard that, originally, was provided with a screw-nut type clamping device. Consequently, the roll standard was provided with a bore 6 with relatively large diameter to allow for the passage of the screw and ending, to the outside, in a recess 61 enabling to house the means for driving the screw into rotation and, to the inside, i.e. on the window side 11, in a recess 62 enabling to house the rotation-fixed nut that rests on the roll standard. The recess 62 exhibits therefore sizes greater than the passage bore 6 of the screw and delineates a ring bottom that can be machined to form a back-up countersink 63 for the nut.

If the screw-nut assembly should be replaced with a hydraulic jack, it is interesting to rest on the roll standard via this machined face 63, but the recess 62 is, normally, insufficient to house the body of a hydraulic jack with sufficient sizes to exert the clamping load.

It is therefore particularly advantageous to reverse the arrangement on FIG. 1, whereas the piston 32 is fixed whereas the body of the jack 31 is mobile.

As in the case of FIG. 1, the piston 32', on which is mounted the cylindrical body 31' of the jack to slide thereon, is extended by a back-up section 34 that, in this case, extended to the rear of the jack. To suit the usual sizes of the recess 62 of the nut, the rear section 34' of the piston is connected to a spacer 35 that can be inserted into the recess 62 to rest on the machined face 63.

In the opposite direction, the body of the jack 31', which is housed in the upper section of the window 11, rests on the chock 21 by its bottom 30 that exhibits sufficient bearing surface for the transmission of the clamping load.

As previously, the measuring rod 4 extends inside a tubular sleeve 5 with a lower end 51 axially integral with the bottom of the cylindrical body 31 and an upper end 52 that slides in a bore 44' provided in the piston 32' and its rear section 34. The bore 44' can be advantageously covered with a jacket along which the sliding joint 32 will run.

The sleeve 5 is extended upward by a sheath 53 that surrounds with a certain clearance the measuring rod 4 up to the outlet of the said rod outside the crosspiece 13. The sheath 53 can be held, at its upper section 54, by a sliding joint 15' that may consist of a single friction bush mounted on a plate 64 closing the bore 6.

As indicated, the bore was designed with rather large sizes for the passage of the screw and, for example, an oil supply tube 36 can pass through it, whereas the said tube is connected to a bore of the piston 32, 34 ending in the pressure chamber 33 and that goes through the plate 64 up to a fitting that enables connecting a supply hose.

Advantageously, the piston 32' is held by its rear section 34' against the back-up face 63 by bolts 65 regularly spaced around the axis and resting on the plate 64.

As indicated above, the external section 54 of the sheath 53 carries a joystick 55 on which rest lifting jacks 56. The assembly is covered with a lid 16 on which is fixed the measuring device, not represented, connected to the rod 4.

It can be seen that the means according to the invention enable without undue complication to retrofit an existing stand while replacing each clamping screw with a single-action hydraulic jack connected to restoring means.

But the invention is not limited to the details of the embodiments that have just been described for exemplification purposes and that could be subject to variations without departing from the scope defined by the claims.

For example, the linking member between the insulating sleeve 5 and the restoring means could consist of two rods extending along the measuring rod 4 and fixed by joints, at their ends, respectively on the sleeve 5 and on the joystick 55.

Besides, the invention has been described within the scope of the measuring device according to the French patent no. 2.645.051 but it could apply to any registration device using a measuring rod connected to the mobile element of the jack and going through an insulating sleeve of the chamber pressure. As stated above, if a swivelling rest is provided between the mobile element of the jack and the chock of the roll to be actuated, the insulating sleeve can be mounted to slide in the bore arranged in the roll standard of the stand, which provides for better tightness. In such an arrangement, the sleeve surrounding the measuring rod can be extended to the outside of the stand by a sheath carrying a joystick or even, a single back-up transversal arm for one or several lifting jacks. In such a case, it is not necessary to provide swivelling joints between the sleeve and the elements of the jack.

Besides, the restoring means could also be modified. For example, the extension sheath 53 could be actuated by a ring jack attached on its external section 54.

What is claimed is:

1. A roll mill comprising a supporting stand with two separate roll standards, at least two superimposed rolls delineating an air-gap for the passage of a product to be rolled along a rolling plane, and having each two ends each rotating inside a supporting block mounted to slide, parallel to a clamping plane passing through the axes of the rolls, between two guiding faces provided on two sides of a window of each roll standard, means for clamping the rolls and acting on at least one roll with adjustable level, comprising two clamping jacks mounted respectively on both standards of the stand and each comprising two elements mounted to slide one into the other and delineating a pressure chamber connected to pressurised fluid supply means, respectively, a mobile back-up element on the supporting block of the corresponding end of the adjustable roll and a fixed element resting on the roll standard of the stand, and means for measuring the position of the adjustable roll comprising, at each end of the roll, a measuring rod having an internal end connected to the mobile element of the clamping jack and extending successively through the pressure chamber, the fixed element of the jack and the roll standard of the stand, up to an opposite end located outside the standard, whereas the said rod goes through a tubular sleeve with a certain clearance that extends into the pressure chamber of the jack in order to preserve the tightness thereof, whereas the said sleeve has an internal end axially integral with the axis of the mobile element of the jack and exhibits an insulating section mounted to slide axially with respect to the fixed element, wherein the tubular sleeve connected to each jack is extended to the outside, beyond the sliding insulating section, by an oblong linking member extending along the measuring rod without any contact with the said rod and going through the roll standard of the stand up to an end located outside the stand and on which is fixed a back-up section of restoring means of the mobile element of the jack toward the fixed element, whereas the said restoring means act onto the mobile element via the linking member and the tubular sleeve, in the direction opposite the clamping direction, while resting on the roll standard of the stand.

2. A roll mill according to claim 1, wherein the linking member is fixed, at its external end, on at least one arm extending transversally and the restoring means comprise at least one jack having a fixed element resting on the roll standard in a transversally offset position with respect to the measuring rod and a mobile element resting on the said transversal arm.

3. A device according to claim 1, wherein a joint is arranged between the sleeve and the linking member in order to allow for misalignments.

4. A device according to claim 1, wherein the oblong linking member is a tubular sheath extending in the line of the insulating sleeve and comprising a central bore with sufficient diameter for the measuring rod to pass through it with a certain clearance.

5. A roll mill according to claim 1, wherein each clamping jack comprises a hollow fixed body resting on the roll standard of the stand and a mobile piston resting on the supporting block of the roll.

6. A roll mill according to claim 1, wherein each clamping jack comprises a fixed piston resting on the roll standard of the stand and a hollow mobile body resting on the supporting block of the roll.

7. A roll mill according to claim 2, wherein the linking member is connected to at least two transversal arms extending symmetrically and forming a joystick on which rest at least two restoring jacks offset on either side of the measuring rod.

8. A device according to claim 4, wherein each standard is provided with sliding guiding means of the sheath.

* * * * *